US005507209A

United States Patent [19]

Allen et al.

[11] Patent Number: 5,507,209

[45] Date of Patent: Apr. 16, 1996

[54] SLEEVE-TYPE SCREW HOLDER AND DRIVER

[76] Inventors: Ronnie K. Allen, 2258 Parker Town Rd., Four Oaks, N.C. 27524; Danny W. Beasley, 9160 U.S. 301 South, Benson, N.C. 27504

[21] Appl. No.: 492,400

[22] Filed: Jun. 19, 1995

[51] Int. Cl.[6] ..... B25B 13/00

[52] U.S. Cl. ..... 81/124.2; 81/125; 81/53.1; 81/901

[58] Field of Search ..... 81/53.1, 121.1, 81/124.2, 125, 177.2, 901, 58

[56] References Cited

U.S. PATENT DOCUMENTS

| | | | |
|---|---|---|---|
| 693,406 | 2/1902 | Kydd | 81/901 |
| 841,472 | 1/1907 | Vanderherchen | 81/901 |
| 882,937 | 3/1908 | Fegley | 81/901 |
| 1,920,168 | 8/1933 | Bodendieck | 81/53.1 |
| 2,099,921 | 11/1937 | Becker | 81/53.1 |
| 2,299,838 | 10/1942 | Mays | 81/53.1 |
| 4,689,881 | 9/1987 | Fall | 81/901 |
| 4,970,921 | 11/1990 | Fagan | 81/53.1 |
| 5,012,624 | 5/1991 | Dahlgren | 81/124.2 |
| 5,439,338 | 8/1995 | Rosenberg | 81/124.2 |

*Primary Examiner*—Bruce M. Kisliuk
*Assistant Examiner*—Joni B. Danganan
*Attorney, Agent, or Firm*—Rhodes, Coats & Bennett

[57] ABSTRACT

A sleeve-type screw holder and driver is shown wherein there is provided an elongated sleeve having a seat formed therein for receiving the head of a screw. In addition, the device includes a screw stabilizer that engages the shaft portion of the screw and stabilizes the entire screw within the elongated sleeve. In order to anchor or set the screw within a securing member, the sleeve is turned until the screw held within the sleeve is properly anchored. Thereafter, the sleeve, including the screw stabilizer, is pulled from the anchored screw.

18 Claims, 5 Drawing Sheets

SLEEVE-TYPE SCREW HOLDER AND DRIVER

FIELD OF THE INVENTION

The present invention relates to structures and devices for holding, retaining and screwing a relatively large wood screw into a supporting member, and more particularly to a sleeve-type screw holder and driver that is adapted to be attached to the end of an extender such that the screw holder and driver can be utilized to anchor a screw in a support member that is elevated out of the reach of an individual's hand.

BACKGROUND OF THE INVENTION

It is well appreciated that screws are commonly used to secure and anchor objects from support members. For example, it is common practice to use wood screws for the purpose of supporting a swing and chain assembly from an elevated support structure. However, the problem that often arises is that of anchoring a screw in a support structure that is stationed at an elevated height that cannot conveniently and easily be reached by hand or even while standing on a ladder. In these situations, it can be difficult to anchor a supporting screw in an elevated support structure.

There are also many applications where a wood screw could be utilized to support a structure if it were easy and convenient to set and anchor such a screw in an elevated support member. For example, many hunters own automatic feeders that are designed to be installed in a tree within a wooded hunting area. Often, the hunters will attempt to mount the feeder in a tree by utilizing a rope or cable structure. This can indeed be a time-consuming and frustrating experience. First, in such cases, it is extremely desirable to mount the feeder at a relatively high height such that it is not easily visible to the wild game or to other hunters for that matter. However, to get the feeder anchored and positioned at such a height is a formidable task. In many cases, the hunter or hunters attempting to mount such a feeder at an appreciable height become frustrated and in the end will settle for mounting the feeder at a relatively low height even sometimes in the path of game and other hunters.

In the case of such feeders, it is desirable to provide a means for mounting the feeders at a relatively high height that is easy and convenient and which will properly secure the feeder without danger of the feeder falling.

Therefore, there is a need for a tool or implement for screwing screws into elevated and hard to reach members. Moreover, there is a need for a simple screw holder for holding and stabilizing a screw while the same is being turned and anchored into a support member.

SUMMARY AND OBJECTS OF THE INVENTION

The present invention entails a sleeve-type screw holder and driver that is designed to receive a relatively large screw, such as a wood screw or lag bolt, and by turning the sleeve-type screw holder and driver a screw held within the device is screwed and anchored into a support member. The sleeve-type screw holder and driver of the present invention entails an elongated sleeve having at least one end open and a seat fixed therein. The seat is designed to receive the head of a screw and to turn the screw as the sleeve is turned. In addition, the sleeve-type screw holder and driver of the present invention includes a screw stabilizer that in an operative mode fits within the sleeve and surrounds a shaft portion of the screw so as to stabilize the entire screw within the sleeve-type holder and driver while the screw is being screwed into a support member. The sleeve-type screw holder and driver of the present invention is designed such that it can be automatically released or separated from the screw once the screw has been securely anchored within a support member.

It is therefore an object of the present invention to provide a screw holder and driver for screwing a screw into a support structure.

Another object of the present invention is to provide a sleeve-type screw holder and driver of the character referred to above that is particularly designed to anchor a screw into an elevated support member that is disposed at a relatively high height and out of the normal range of a person's hand.

Another object of the present invention resides in a screw holder and driver of the character referred to above that is capable of screwing a screw into a support structure and thereafter actually unscrewing and retrieving the same screw.

A further object of the present invention resides in the provision of a sleeve-type screw holder and driver that is adapted to be secured to the remote end of an elongated handle which facilitates the screw holder and driver reaching elevated areas.

Another object of the present invention is to provide a sleeve-type screw holder and driver that is specifically designed with a screw stabilizer that holds the screw in a stable orientation while the screw is being screwed into a support structure and wherein the sleeve-type device and associated structure is designed such that the same can be easily separated from the screw once the same has been anchored into the support member.

Other objects and advantages of the present invention will become apparent and obvious from a study of the following description and the accompanying drawings which are merely illustrative of such invention.

DETAILED DESCRIPTION OF THE INVENTION

Figure 1:
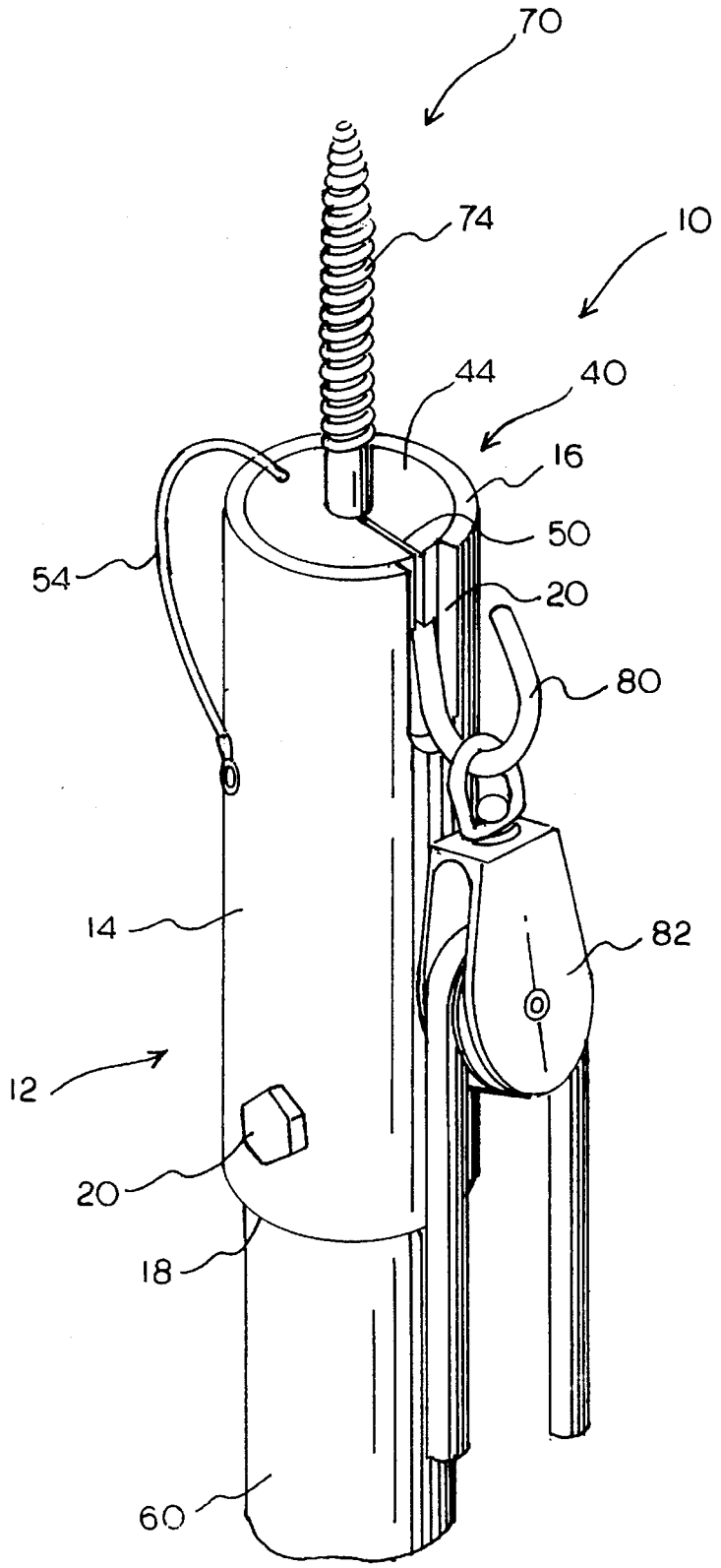
FIG. 1 is a perspective view of the screw holder and driver of the present invention.

With further reference to the drawings, the screw holder and driver of the present invention is shown therein and indicated generally by the numeral 10. As will be appreciated from subsequent portions of this disclosure, the screw holder and driver 10 is designed to receive a conventional screw of various sizes and to retain the screw therein while the screw holder and driver is rotated causing the screw to be screwed into a support member. In addition, the screw holder and driver 10 can be utilized to unscrew the screw and remove the same from the support member.

Now, turning to the construction of the screw holder and driver 10, it is seen that the same includes an elongated hollow sleeve indicated generally by the numeral 12. Sleeve 12 can be constructed of any suitable material such as plastic or PVC piping or the like. Sleeve 12 includes a cylindrical side wall 14 and an open end 16. Formed in the cylindrical side wall 14 adjacent the open end 16 is a vertical side slot 22. See FIG. 1. Disposed opposite open end 16 is what is referred to as an attaching end 18 that includes a transverse bolt assembly 20 extending therethrough. As will be appreciated from subsequent portions of this disclosure, the attaching end 18 is designed to be mounted to an extender 60 such as a limb trimmer or other extensible utility rod.

Figure 2:
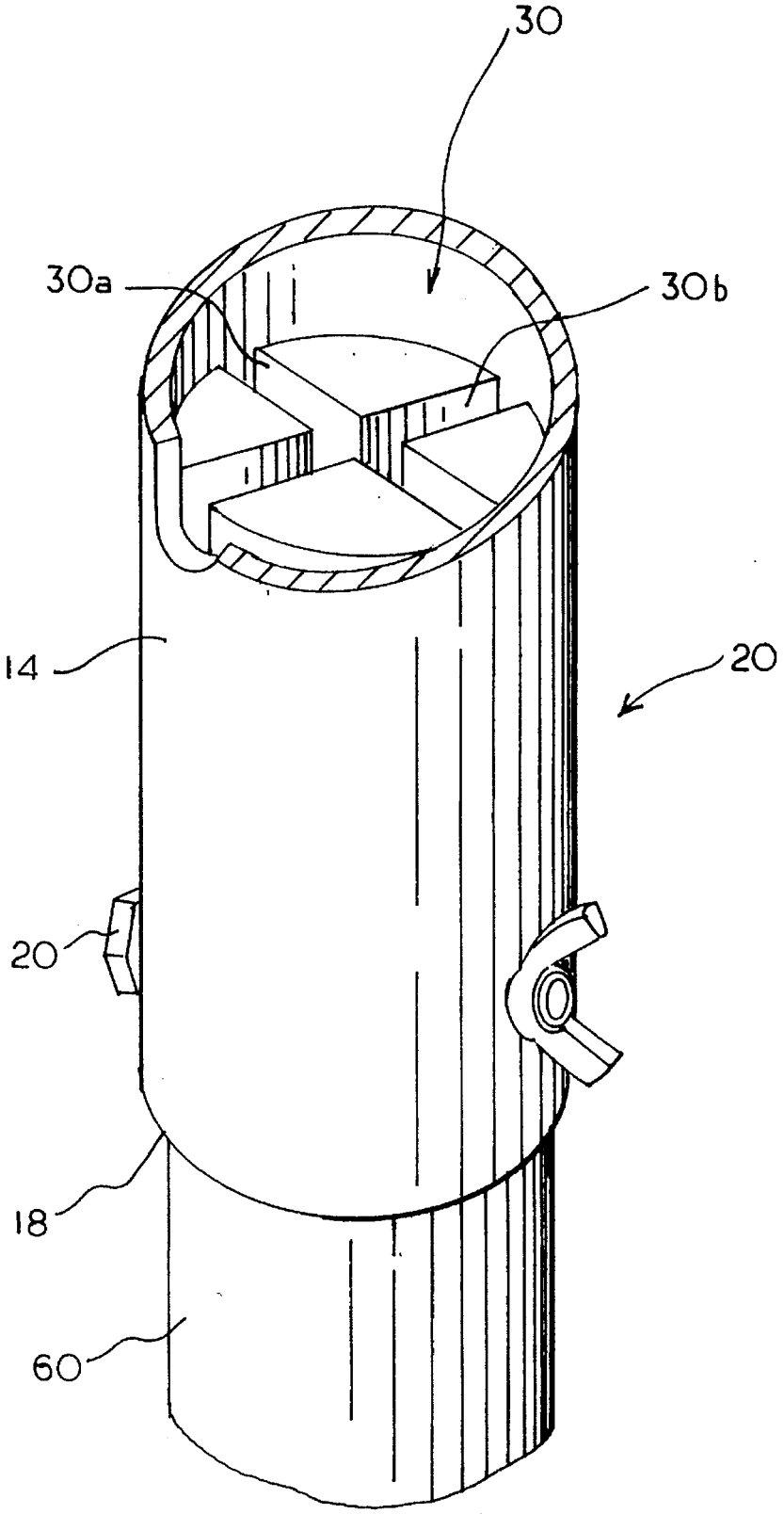
FIG. 2 is a perspective view of a portion of the screw holder and driver with the top portion of the sleeve being cut to better illustrate the seat structure formed within the sleeve.

Disposed within the sleeve 12 generally between the open end 16 and the attaching end 18 is a seat structure 30. Seat 30 includes a pair of notches 30*a* and 30*b* that face the open end 16 of the sleeve 12. As seen in FIG. 2, notches 30*a* and 30*b* are disposed at right angles to each other. As will be appreciated from subsequent portions of this disclosure, the function of the respective notches 30*a* and 30*b* is to receive the head of a screw 72 in such a fashion that the notches turn the screw as the sleeve 12 is turned because the entire seat structure 30 is fixed within the sleeve 12.

Figure 3:
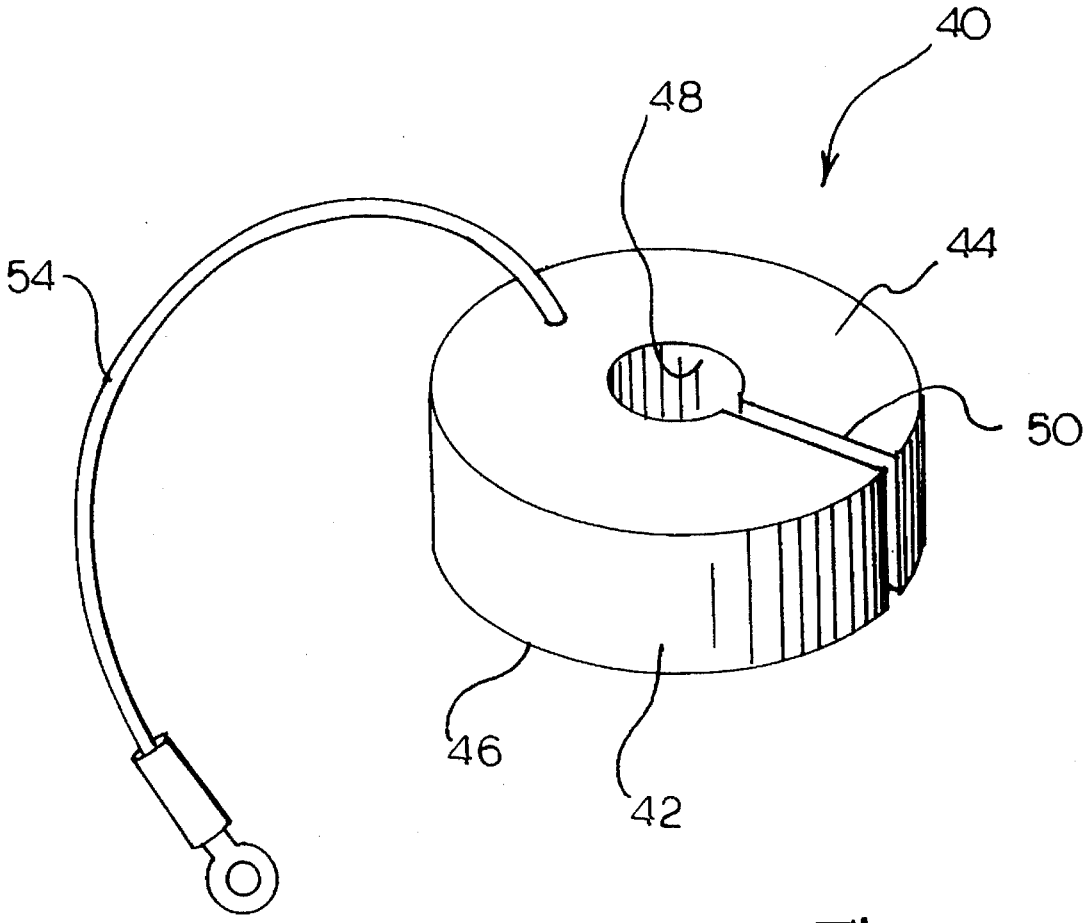
FIG. 3 is a perspective view of a screw stabilizer and attaching cable that forms a part of the screw holder and driver shown in FIG. 1.

Attached to the sleeve 12 is a screw stabilizer indicated generally by the numeral 40. Screw stabilizer 40 can be constructed of various materials. In the example shown in the drawings, the screw stabilizer 40 is made of a relatively hard rubber material. As seen in FIG. 3 of the drawings, screw stabilizer 40 includes a round edge 42, a top 44 and a bottom 46. A through opening 48 is formed within the central portion of the stabilizer 40 and an elongated thin slit 50 extends from the edge 2 of the stabilizer to the generally central opening 48. Stabilizer 40, in the design of FIG. 1, is attached by a flexible tie line 54 that is secured to an exterior side of the cylindrical side wall 14.

Sleeve 12 can be utilized without an associated extender 60. However, sleeve 12 is designed to accept a terminal end of an extender 60. Note that in the design disclosed, that the extender 60 would include a transverse screw opening about its terminal end and that the terminal end thereof would be inserted into the attaching end 18 of the sleeve 12. The bolt assembly 20 would then be extended through the sleeve 12 and through the opening within the terminal end of the extender 60 so as to secure the sleeve 12 to the extender 60. Various extender designs can be used. For example, the sleeve 12 could be adapted to fit the end of a conventional limb trimmer or other type of elongated pipe or extensible member.

As shown in FIG. 1, the screw holder and driver 10 of the present invention is designed to hold and support a screw while the same is being screwed into a supporting member. For purposes of explanation, a screw is shown in the drawings and indicated generally by the numeral 70. Screw 70 can be of any conventional design such as a lag screw, wood screw or the like. In the design illustrated herein, the screw 70 includes a head 72 that is in the form of an eyelet and a shaft 74 that extends from the head and is at least partially threaded. But it should be appreciated, that other types and forms of screws could be utilized and the screw holder and driver 10 of the present invention could be designed and sized to accommodate such designs.

As discussed before, there are applications where it would be desirable for the screw 70 to be attached to a rope, cable or the like when the same is screwed into a supporting structure such as a tree limb for example. In the case of one example shown herein, the screw 70 can be provided with an S-hook 80 and a pulley block 82 connected to the S-hook 80. See FIG. 5. In order to pull an object upwardly adjacent an anchored screw 70, a cable or rope would be threaded through the pulley block assembly 82. Thus, it is appreciated that once the screw 70 is anchored within a support structure, that one end of the rope or cable could be fastened to an object to be suspended and the other end of the rope or cable can be pulled causing the object to be pulled up to a point adjacent the anchored screw 70. In certain cases, it would not be required for the screw 70 to be provided with a tackle assembly such as the S-hook 80 and pulley block assembly 82. For example, in some cases it may be only desirable to simply thread a rope through the head or eyelet portion of the screw.

Figure 5:
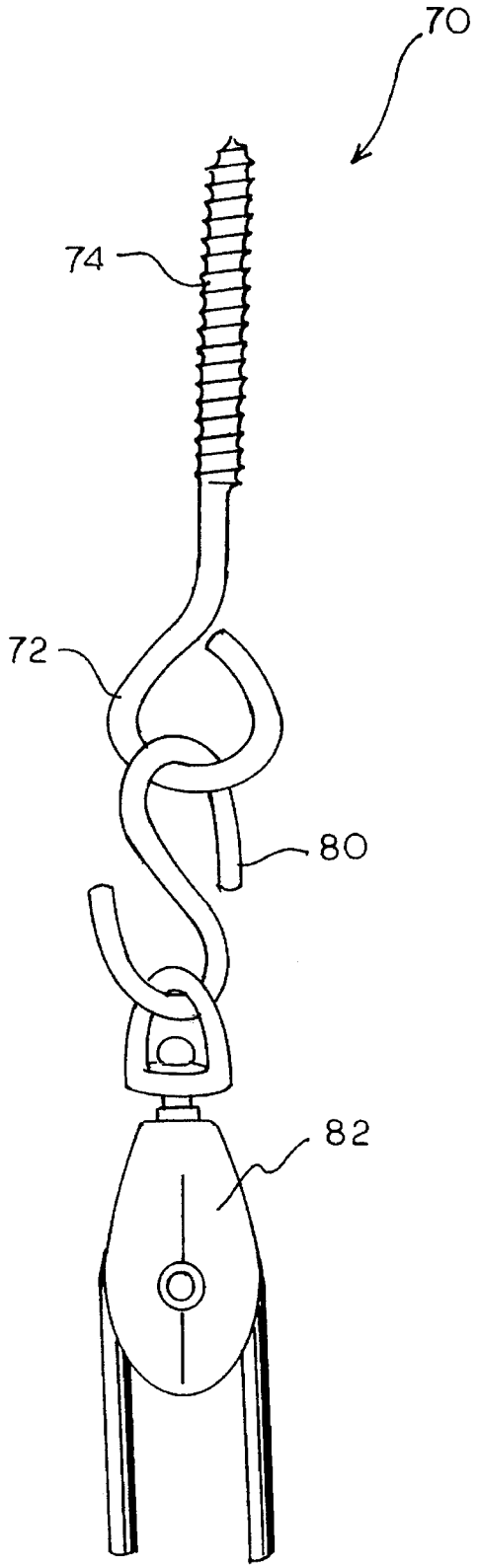
FIG. 5 is a view illustrating a wood screw and an attaching structure that is capable of being handled by the screw holder and driver of the present invention.

Turning back to a review of the structure of the sleeve 12, it is appreciated that the vertical side slot 22 formed in the sleeve 12 will accommodate such a tackle assembly (as shown in FIG. 5) or a rope. That is, while the screw 70 is seated within the sleeve 12, associated tackle structures such as the S-hook 80 and pulley block assembly 82 could extend from the screw head 72 out the side of sleeve 12 through side slot 22. Likewise, in cases where only a rope or cable is utilized, the rope or cable after being threaded through the head 72 would also extend out the sleeve through the side slot 22.

In the design shown in FIGS. 1–3, the screw stabilizer 40 is designed to be frictionally inserted into the open end 16 of the sleeve 12. In particular, the screw stabilizer 40 is designed to move in and out of the open end 16 of the sleeve 12. Also, in the design shown in FIG. 1, the sleeve is provided with a single vertical elongated slot 22 formed adjacent the upper open end 16.

Figure 4:
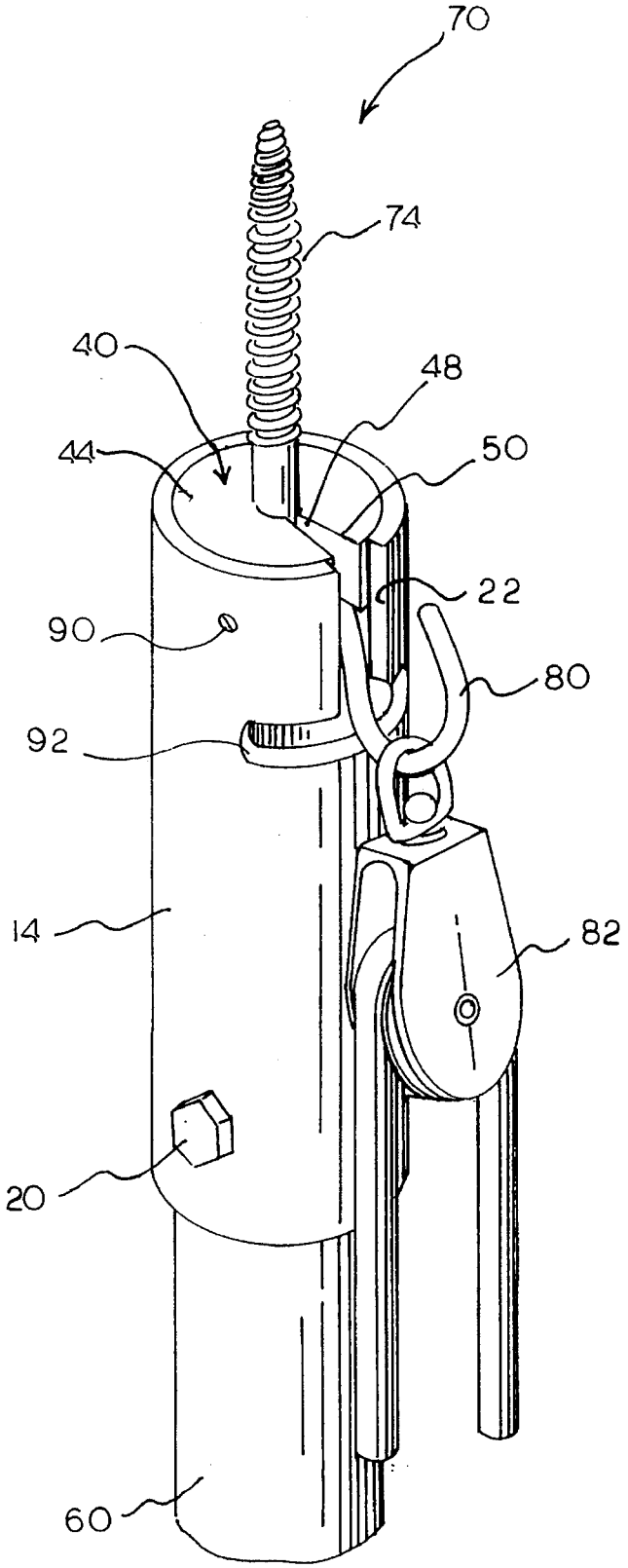
FIG. 4 is a perspective view of an alternate design of the screw holder and driver of the present invention.

Now, turning to the alternate design for the screw holder and driver 10 of the present invention that is shown in FIG. 4, there are two basic differences in this design compared to the design of FIG. 1. First, in the alternate design shown in FIG. 4, the screw stabilizer 40 is fixed into the open end 16 by one or more fasteners 90 that extend through the side wall of sleeve 12 into the screw stabilizer 40. In this case, the central opening 48 and slit 50 maybe slightly altered compared to the designs shown in FIGS. 1 and 3 so as to facilitate the removal of the screw 70 once the screw has been anchored into a supporting member. Note in FIG. 4, that the central opening 48 formed in the screw stabilizer 40 and the slit 50 is of a more open design than that shown in FIG. 1, again to facilitate the removal of the screw 70 from the stabilizer 40.

Also, the embodiment shown in FIG. 4 includes a transverse slot 92 formed in the side wall of the sleeve 12. Transverse slot 92 extends across the lower end of vertical slot 22 and is spaced just above the seat structure 30 that is disposed within the sleeve 12. The addition of the transverse slot 92 enables the screw 70 to be seated within the seat structure 30 and yet be attached to additional attaching structure or tackle. More particularly, the transverse slot 92 enables certain shaped and sized attaching structure to extend through the transverse slot 92 while still being connected to the screw 70.

In addition, it should be pointed out that the screw stabilizer 40 could in certain cases be constructed of material more rigid than even the relatively hard rubber. For example, it is contemplated that in certain cases the screw stabilizer 40 could be formed of a hardened metal material with a central opening and side slots formed therein to particularly accommodate a certain size screw. In this case, the screw would essentially snap in and out of the side slot opening formed in the screw stabilizer.

Turning to the operation of the screw holder and driver 10 of FIG. 1, it is seen that in a non-operative mode, that the screw stabilizer 40 is simply attached to the flexible tie line 54 and lies outside of the interior of the sleeve 12. In order to anchor or screw a screw 70 into a support member such as a beam, tree limb, or the like, the head 72 of the screw 70 is inserted downwardly through the open end 16 of the sleeve. The head 72 is placed in a respective notch 30*a* or 30*b* of the fixed seat structure 30. Before the screw 70 is actually seated in the seat structure 30, the screw stabilizer 40 is placed around the shaft 74 of the screw 70. In the embodiment illustrated herein, the screw stabilizer 40 is placed in an intermediate region of the shaft 70 or between the threaded portion of the shaft and the head 72. As the head 72 is seated within a notch 30*a* or 30*b*, the screw stabilizer 40 which surrounds the shaft 74 of the screw is inserted into the open end 16 of the sleeve. Screw stabilizer 40 is designed to fit by friction in the open end 16 of the sleeve. Consequently, as seen in the drawings, particularly FIG. 1, the screw 70 is securely held and seated within the sleeve 12. Again, it is appreciated that while screw 70 is disposed within sleeve 12, that the associated attaching structure or tackle would extend from the sleeve 12 through the side slot 22.

Now, the entire sleeve can be positioned adjacent a supporting structure such as a beam or a tree limb. In the case where the sleeve 12 is attached to an extender 60, the extender is positioned such that the terminal or pointed end of the screw 70 is engaged with the support member. Thereafter, the extender is turned and the torque associated with the extender 60 is transferred to the screw 70 via sleeve 12. In particular, as the sleeve 12 is turned, the respective notch 30*a* or 30*b* holding the screw head 72 effectively turns the screw while the screw is stabilized by the screw stabilizer 40. Once the screw 70 is set or properly anchored in the support member, sleeve 12 can be disengaged from the screw 70 by simply pulling the sleeve away from the screw. As the sleeve 12 is pulled away, it is appreciated that the screw head 72 simply departs and moves out of a respective notch 30*a* or 30*b* towards the open end 16 of the sleeve. At the same time, the screw stabilizer 40 is snapped out of frictional engagement with the open end 16 and during this process as the sleeve 12 is pulled away from the screw 70, the screw stabilizer 40 is able to separate from the screw inasmuch as the slit 50 formed in the screw stabilizer 40 enables the shaft 74 of the screw to be pulled therethrough.

Another feature of the present invention entails retrieval of a previously anchored screw 70. That is, once it is desirable to remove the screw 70 from the support structure, the sleeve 12 with the screw stabilizer 40 removed from the open end 16, can be inserted around the screw such that the screw head 72 projects into a respective notch 30*a* or 30*b*. Thereafter, the sleeve 12 can be rotated so as to unscrew the screw 70 from the supporting structure.

In the case of the embodiment illustrated in FIG. 4, the basic operation of the screw holder and driver is essentially the same as discussed above. However, in the case of the embodiment illustrated in FIG. 4, the screw stabilizer 40 is securely anchored within the open end 16 of sleeve 12. This means that the screw stabilizer 40 of the embodiment shown in FIG. 4 does not pop out of the sleeve during the process of removing the screw 70 from the screw holder and driver. In addition, the design shown in FIG. 4 includes not only the vertical slot 22 but a lower transverse slot 92, both formed in the cylindrical side wall 14 of the sleeve. Again, slots 22 and 92 enable various attaching structure or tackle structure to extend through the sleeve 12 while still connected to screw 70 that is held and supported in a stabilized mode within the sleeve 12. In the case of the design shown in FIG. 4, once the screw 70 has been screwed into a supporting member, the entire sleeve is pulled down or away from the screw and in this process the screw 70 is pulled from the central opening 48 and the adjacent elongated slit 50 formed in the screw stabilizer. It is appreciated that with the design shown in FIG. 4 that the sleeve 12 is preferably moved to one side during the process of separating the same from the screw. This allows the entire screw 70 to exit the sleeve through the vertical side slot 22.

It should be appreciated that the screw holder and driver 10 of the present invention can be utilized with or without an extender 60. Also, it is appreciated that the screw holder and driver 10 has a wide range of utility that enables the same to be utilized to handle various types and sizes of screws with various connecting tackle structure. Again, the screw holder and driver 10 of the present invention is particularly beneficial in hanging an animal feeder by anchoring the support screw at an elevated height within a tree limb or other type of supporting structure.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A device for holding, retaining and driving a screw having a head and a shaft portion, comprising:

a) an elongated sleeve having an open end;

b) a seat formed in the sleeve and spaced from the open end for receiving the head of a screw, the seat including an engaging structure for receiving the head of the screw and turning the screw as the sleeve is turned;

c) a slot formed in the sleeve adjacent the open end thereof for permitting a screw attachment to extend therethrough;

d) a screw stabilizer formed to fit in the open end of the sleeve and including an expandable slot formed therein for extending around a portion of the screw spaced from the head of the screw so as to stabilize the screw within the sleeve while the head of the screw is retained within the seat;

e) a flexible line interconnecting the screw stabilizer with the sleeve so as to maintain the screw stabilizer in relatively close proximity to the sleeve; and f) wherein the stabilizer is sized to frictionally fit in the open end of the sleeve and wherein the slot formed within the screw stabilizer is expandable such that a retained screw can be pulled from the stabilizer and through the slot formed therein in response to the sleeve being pulled away from the screw once the screw has been anchored into a supporting member.

2. The device of claim 1 wherein the slot of the screw stabilizer includes a generally central screw opening and an elongated slit that extends from the central screw opening to a side of the screw stabilizer, whereby the screw may be separated from the screw stabilizer by pulling the screw from the central screw opening through the elongated slit formed in the screw stabilizer.

3. The device of claim 1 wherein the sleeve includes means for attaching the same to an elongated extender.

4. The device of claim 1 wherein the seat formed within the sleeve includes at least one elongated notch for receiving the screw head of the screw.

5. The device of claim 4 wherein the seat includes at least two elongated notches that intersect and which are disposed approximately 90° apart.

6. A screw holder for holding a screw of the type having a screw head and a shaft while the screw is screwed into a member and wherein the screw holder is separable from the screw after the screw has been screwed into the member, the screw holder comprising: a screw holder sleeve; a seat fixed in the sleeve for receiving the screw head of the screw and for turning the screw in response to the sleeve being turned; a screw stabilizer for engaging a portion of the screw spaced from the screw head and stabilizing same while the sleeve is turned and the screw is screwed into the member; wherein the screw stabilizer assumes a position within the sleeve spaced from the seat while the sleeve is being turned and the screw is being screwed into the member; and wherein the screw stabilizer includes an expandable opening for receiving the screw shaft and wherein the expandable opening permits the screws stabilizer to be pulled and separated from the screw once the screw has been securely anchored.

7. The screw holder of claim 6 wherein the screw stabilizer is interconnected to the sleeve such that the sleeve and the screw stabilizer form an integral unit.

8. The screw holder of claim 6 wherein the screw stabilizer is formed of a rubber structure that includes a slit formed from an edge of the rubber structure to a central region therein and wherein the slit enables the screw stabilizer to be pulled from an anchored screw.

9. The screw holder of claim 6 wherein the screw stabilizer is connected to the sleeve by a flexible tie line, and wherein the screw stabilizer is designed to frictionally fit into an open top portion of the sleeve and wherein the screw stabilizer can be moved between a stabilizing position inserted within the sleeve and a position outside of the sleeve.

10. A screw holder of claim 6 wherein the seat comprises a structure for engaging the screw head of the screw and for turning the screw as the sleeve itself is turned.

11. The screw holder of claim 6 wherein the screw holder sleeve includes an open end through which the screw projects while being held by the screw holder and wherein the screw stabilizer is secured in the open end of the sleeve.

12. The screw holder of claim 6 wherein the seat includes a structure for engaging the screw head of a screw and for turning the screw as the sleeve itself is turned; and wherein there is provided a pair of elongated slots formed in the sleeve with one slot extending generally vertically from the open end of sleeve to a point adjacent the seat and wherein the other slot extends transversely across the sleeve adjacent the seat and wherein the slot enables attaching structure to extend from the sleeve therethrough while such attaching structure is secured to the screw disposed within the sleeve.

13. A screw holder and drive for driving a screw into a member, comprising:

a) an elongated sleeve having an open end for receiving, holding and turning a screw having a screw head and a threaded shaft;

b) a seat fixed in the elongated sleeve;

c) the seat including a screw turner for engaging and turning the screw in response to a sleeve being turned;

d) a movable stabilizer for engaging and holding a portion of the screw spaced from the screw head while the sleeve is turned and the screw is being screwed into the member; and e) wherein the screw stabilizer assumes a position within the sleeve spaced from the seat while the sleeve is being turned and the screw is being anchored into a member but wherein the screw stabilizer is removable from within the sleeve in response to the sleeve being pulled from the screw after the screw has been anchored into the member, as the screw itself engages the stabilizer and pulls the stabilizer from within the sleeve as the sleeve is pulled away from the anchored screw.

14. The screw holder and drive of claim 13 wherein the screw stabilizer includes a central opening for receiving the shaft of the screw.

15. The screw holder and drive of claim 13 wherein the screw stabilizer is constructed of a relatively hard rubber material.

16. The screw holder and drive of claim 13 including a flexible connector interconnected between the sleeve and the screw stabilizer for retaining the screw stabilizer in close proximity to the sleeve.

17. The screw holder and drive of claim 13 further including means associated with the sleeve for attaching the sleeve to an extender.

18. The screw holder and drive of claim 13 including a slot formed in the sleeve adjacent the open end for allowing an attachment structure carried by the screw to extend therethrough while the screw is seated within the sleeve.

* * * * *